US011598210B1

(12) United States Patent
Zheng et al.

(10) Patent No.: US 11,598,210 B1
(45) Date of Patent: Mar. 7, 2023

(54) TUNNEL PROTECTION STRUCTURE SUITABLE FOR ACTIVE FAULT AREAS AND HIGH GROUND STRESS AREAS

(71) Applicant: Institute of Geology and Geophysics, Chinese Academy of Sciences, Beijing (CN)

(72) Inventors: Bowen Zheng, Beijing (CN); Shengwen Qi, Beijing (CN); Yongshuang Zhang, Beijing (CN); Songfeng Guo, Beijing (CN); Manchao He, Beijing (CN); Hui Zhou, Beijing (CN)

(73) Assignee: Institute of Geology and Geophysics, Chinese Academy of Sciences, Beijing (CN)

( * ) Notice: Subject to any disclaimer, the term of this patent is extended or adjusted under 35 U.S.C. 154(b) by 0 days.

(21) Appl. No.: 17/889,407

(22) Filed: Aug. 17, 2022

(30) Foreign Application Priority Data

Sep. 27, 2021 (CN) ..... 202111132144.9

(51) Int. Cl.
*E21D 11/05* (2006.01)

(52) U.S. Cl.
CPC ..... *E21D 11/05* (2013.01)

(58) Field of Classification Search
CPC ..... E21D 11/04; E21D 11/05; E02D 27/34; E04H 9/02
See application file for complete search history.

(56) References Cited

FOREIGN PATENT DOCUMENTS

| | | | | |
|---|---|---|---|---|
| CN | 1085487633 | A | | 9/2018 |
| CN | 110159315 | A | | 8/2019 |
| CN | 111287756 | A | | 6/2020 |
| FR | 3021346 | A1 | * | 11/2015 |
| JP | 7-324340 | A | * | 12/1995 |
| JP | 2000-204891 | A | * | 7/2000 |
| JP | 2014-15821 | A | * | 1/2014 |

* cited by examiner

*Primary Examiner* — Sunil Singh
(74) *Attorney, Agent, or Firm* — Don D. Cha; HDC Intellectual Property Law, LLP

(57) ABSTRACT

Disclosed is a tunnel protection structure suitable for active fault areas and high ground stress areas, and relates to the technical field of tunnel engineering construction. The tunnel protection structure comprises at least one protection unit, wherein a plurality of protection units are sequentially connected and distributed along the axial direction of a tunnel, and the protection units comprise a radial protection ring and two axial protection rings which are fixedly arranged between a lining structure and surrounding rock and are distributed along the axial direction of the tunnel; the radial protection ring comprises a plurality of radial buffer energy consumption layers which are sequentially sleeved along the radial direction of the tunnel; and the axial protection ring comprises a plurality of axial buffer energy consumption layers which are sequentially and fixedly connected along the axial direction of the tunnel.

8 Claims, 7 Drawing Sheets

TUNNEL PROTECTION STRUCTURE SUITABLE FOR ACTIVE FAULT AREAS AND HIGH GROUND STRESS AREAS

This patent application claims the priority benefit of Chinese Patent Application No. 202111132144.9, filed on Sep. 27, 2021, the disclosure of which is incorporated by reference herein in its entirety as part of the present application.

TECHNICAL FIELD

The present disclosure relates to the technical field of tunnel engineering construction, in particular to a tunnel protection structure suitable for active fault areas and high ground stress areas.

BACKGROUND ART

The Sichuan-Tibet railway traffic gallery is complex in geological conditions, dense in active faults and generally high in ground stress, and the active faults and the high ground stress act on the surrounding rock of the railway tunnel engineering at the same time, so that the surrounding rock generates severe radial deformation and axial deformation and accumulates high strain energy, construction earthquake disasters and engineering disasters such as tunnel engineering construction (structure) dislocation, rock burst and large deformation are easily induced, and construction, operation and maintenance of Sichuan-Tibet railways are seriously threatened. Research and development of tunnel engineering protection measures suitable for environmental conditions with crossing active faults and high ground stress are key points for determining success and failure of tunnel engineering.

Aiming at the protection aspect of tunnel engineering crossing active faults, the patent with the publication number of CN111287756A discloses only a single protection structure form which is not strong enough during the fault activity of a normal fault, a reverse fault and a strike-slip fault. In addition, the anti-dislocation effect is unknown. The tunnel structure disclosed in the patent with the publication number of CN110159315A uses high cost materials and also requires high construction standards. The anti-seismic structure disclosed in the patent with the publication number of CN108547633A also uses high cost materials. In addition, the anti-dislocation effects of the anti-seismic structures in these patents are highly uncertain when the damping ring is built in a pressure injection mode. Furthermore, the adverse effect of the high ground stress environment on tunnel engineering are not considered in these patents.

Therefore, there is a need for a low cost tunnel protection structure which resists active faults and dislocation under high ground stress environment conditions.

SUMMARY

The present disclosure provides a tunnel protection structure suitable for active fault areas and high ground stress areas to overcome many shortcomings in prior art. The tunnel protection structure of the present disclosure is suitable for environmental conditions with crossing active faults and high ground stress, thereby ensuring safety and the stability of a tunnel.

One particular aspect of the disclosure provides a tunnel protection structure suitable for active fault areas and high ground stress areas, said tunnel protection structure comprising:

at least one protection unit, wherein a plurality of protection units are sequentially connected and distributed along the axial direction of a tunnel, the protection units comprise a radial protection ring and two axial protection rings which are fixedly arranged between a lining structure and surrounding rock and are distributed along the axial direction of the tunnel, and the two axial protection rings are respectively arranged on the two sides of the radial protection ring; the radial protection ring comprises a plurality of radial buffer energy consumption layers which are sequentially sleeved along the radial direction of the tunnel, each radial buffer energy consumption layer has radial buffer performance and radial energy consumption performance, and the radial buffer performance of each radial buffer energy consumption layer is gradually increased and the radial energy consumption performance of each radial buffer energy consumption layer is gradually decreased from outside to inside along the radial direction of the tunnel; and the axial protection ring comprises a plurality of axial buffer energy consumption layers which are sequentially and fixedly connected along the axial direction of the tunnel, each axial buffer energy consumption layer has axial buffer performance and axial energy consumption performance, and the axial buffer performance of each axial buffer energy consumption layer is gradually increased and the axial energy consumption performance of each axial buffer energy consumption layer is gradually decreased from outside to inside along the axial direction of the tunnel.

Preferably, each radial buffer energy consumption layer comprises a plurality of radial tire layers which are sequentially and fixedly connected around the axis of the tunnel, each radial tire layer comprises a plurality of radial tires which are annularly distributed around the axial direction of the tunnel and are sequentially and fixedly connected, and the axis of each radial tire is parallel to the axis of the tunnel; each axial buffer energy consumption layer comprises a plurality of axial tire layers sequentially sleeved along the radial direction of the tunnel, each axial tire layer comprises a plurality of axial tires annularly distributed around the axis of the tunnel and sequentially and fixedly connected, and the axis of each axial tire is perpendicular to the axis of the tunnel; and the radial tires and the axial tires are filled with buffer energy consumption materials, the buffer performance of the buffer energy consumption material filled in the radial tire is gradually increased and the energy consumption performance of the buffer energy consumption material filled in the radial tire is gradually decreased from outside to inside along the radial direction of the tunnel, and the buffer performance of the buffer energy consumption material filled in the axial tire is gradually increased and the energy consumption performance of the buffer energy consumption material filled in the axial tire is gradually decreased from outside to inside along the axial direction of the tunnel.

Preferably, the diameter and the thickness of each radial tire are gradually increased from inside to outside along the radial direction of the tunnel, the thicknesses of the radial buffer energy consumption layers along the axial direction of the tunnel are the same, and each radial tire can abut against at least two adjacent radial tires in the adjacent buffer energy consumption layers.

Preferably, the gaps between the adjacent radial tires, the gaps between the adjacent axial tires and the gaps between the radial tires and the axial tires which are adjacent to each other are filled with the buffer energy consumption materials.

Preferably, the radial tires and the axial tires are waste tires.

Preferably, the adjacent radial tire layers are bonded and fixed.

Preferably, the centers of the radial tires in the same radial tire layer are sequentially connected through first anchor rods, the radial tire layer located on the outermost layer is an outward tire layer, the thickness of the outward tire layer is integral multiples of the thickness of each radial tire layer located between the outward tire layer and the tunnel, a plurality of radial tires distributed along the axial direction of the tunnel in the radial buffer energy consumption layer form a radial tire part, the thickness of the radial tire part is the same as that of the outward tire layer, and the centers of every two adjacent radial tire parts in every two adjacent radial buffer energy consumption layers are connected through second anchor rods.

Preferably, the axial tires of the outermost axial tire layer and the axial tires of the innermost axial tire layer are sequentially connected around the axis of the tunnel through third anchor rods respectively, and contact points of the adjacent axial tires located on different axial tire layers are fixedly connected through fourth anchor rods sequentially.

Preferably, the contact positions of the adjacent radial tires and the adjacent axial tires are fixedly connected through fifth anchor rods.

Compared with the prior art, the present disclosure has the following technical effects:

According to the tunnel protection structure suitable for active fault areas and high ground stress areas provided by the present disclosure, when surrounding rock is seriously deformed, firstly, the radial buffer energy consumption layer and the axial buffer energy consumption layer on the outer layer perform energy consumption on radial large deformation and axial large deformation respectively, in the deformation process of the surrounding rock, the radial high-strain energy and the axial high-strain energy are rapidly reduced, then the radial buffer energy consumption layer and the axial buffer energy consumption layer on the inner layer buffer the radial large deformation and the axial large deformation respectively, and the situation that radial deformation of surrounding rock is transmitted to the tunnel to damage the tunnel is avoided.

BRIEF DESCRIPTION OF THE DRAWINGS

The present disclosure will be described with regard to the accompanying drawings, which assist in illustrating various features of the disclosure. It should be appreciated that the attached figures in the following description are provided solely for the purpose of illustrating the practice of the disclosure and do not constitute limitations on the scope thereof as certain variations and modifications, other variations and modifications are well within the skill and knowledge of those skilled in the art, after understanding the present disclosure.

Reference signs in the attached figures: 1, axial direction of tunnel; 2, axial protection ring; 21, axial tire; 22, axial buffer energy consumption layer; 23, axial tire layer; 24, fourth anchor rod; 25, third anchor rod; 26, fifth anchor rod; 3, radial protection ring; 31, radial tire; 32, first anchor rod; 33, second anchor rod; 34, radial tire layer; 35, radial tire part; 100, tunnel protection structure suitable for active fault areas and high ground stress areas; 200, surrounding rock; 300, lining structure; and 400, protection unit.

DETAILED DESCRIPTION OF THE EMBODIMENTS

The present disclosure will now be described with regard to the accompanying drawings, which assist in illustrating various features of the invention. It should be appreciated that the scope of the disclosure is not limited to merely those embodiments described herein and shown in accompanying drawings. All variations of embodiments apparent to one of ordinary skill in the art having read the present disclosure are also within the scope of this disclosure.

The present disclosure provides a tunnel protection structure that is suitable for active fault areas and high ground stress areas and that overcomes shortcomings in the prior art. The tunnel protection structure of the disclosure is particularly useful and suitable for areas with crossing active faults and high ground stress. The tunnel protection structure of the disclosure ensures the safety and the stability of tunnel.

To make the foregoing objective, features and advantages of the present disclosure clearer and more comprehensible, the present disclosure is further described in detail below with reference to the attached figures and specific embodiments.

Figure 1:
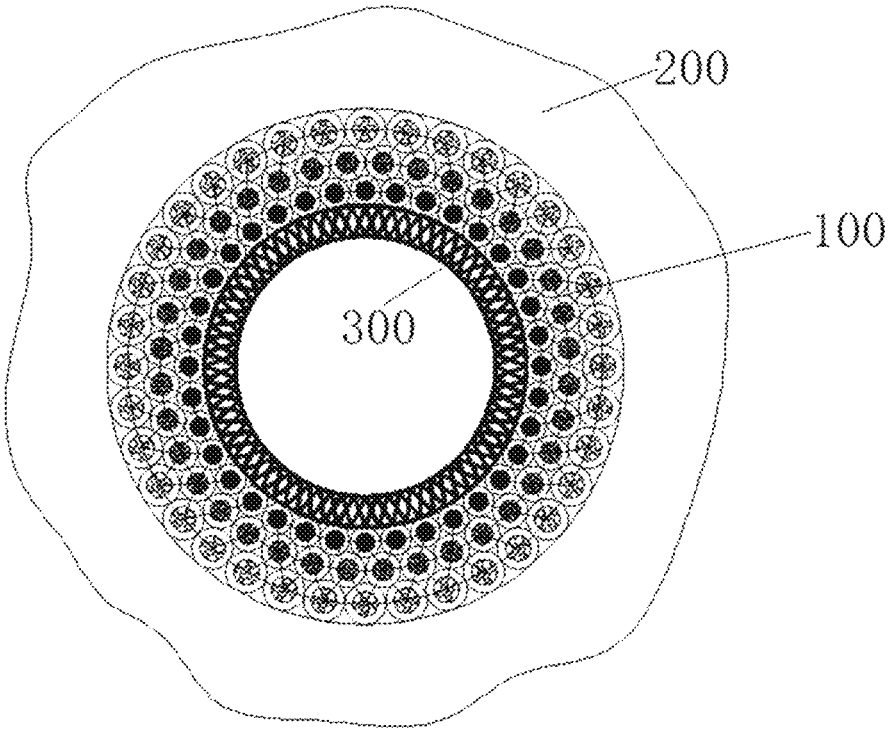
FIG. 1 is one embodiment of a structural schematic diagram of a tunnel protection structure suitable for active fault areas and high ground stress areas provided by the present disclosure.
Figure 2:
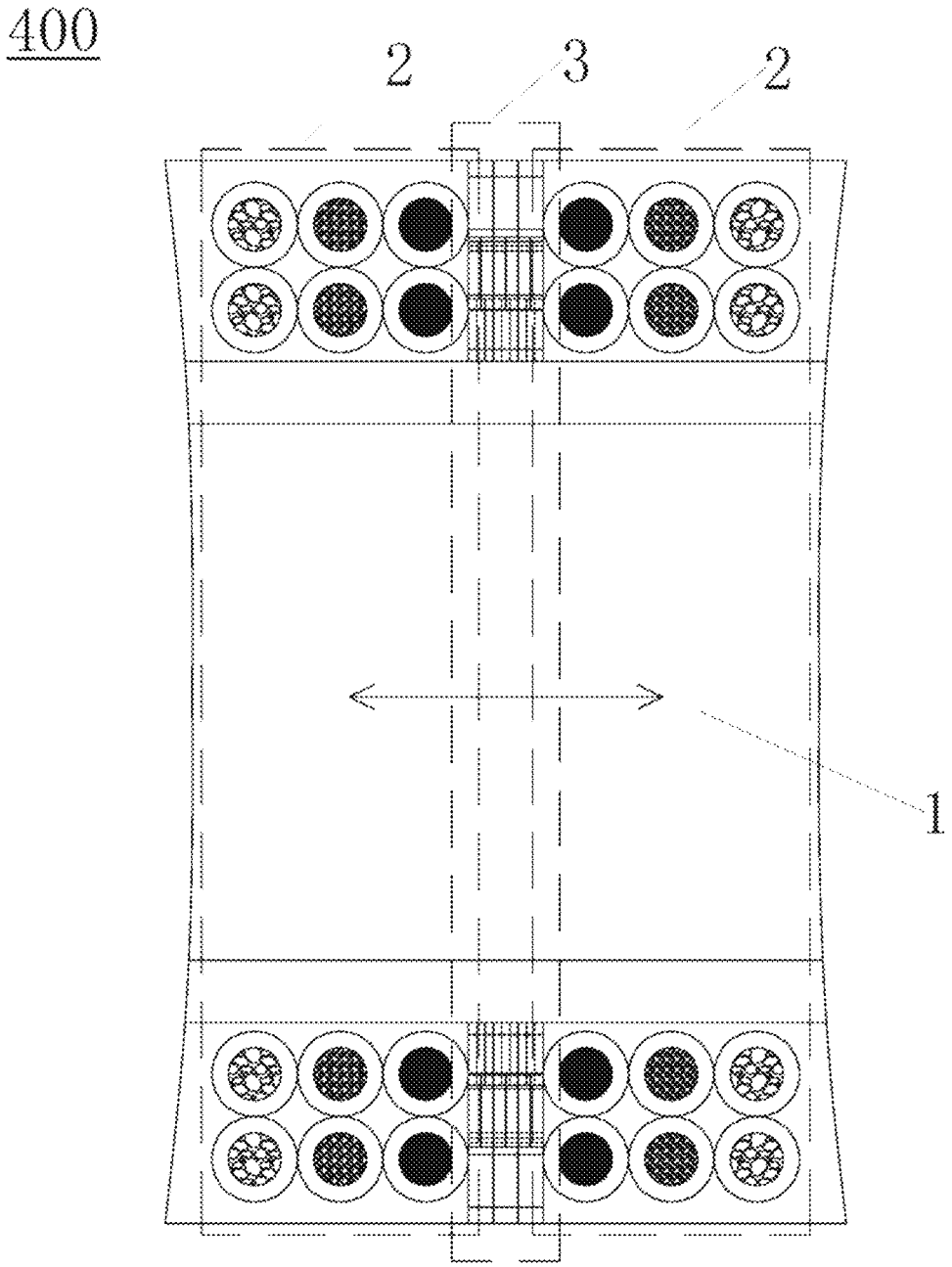
FIG. 2 is a cross-section diagram of one embodiment of a tunnel protection structure suitable for active fault areas and high ground stress areas along the axial direction of a tunnel provided by the present disclosure.
Figure 3:
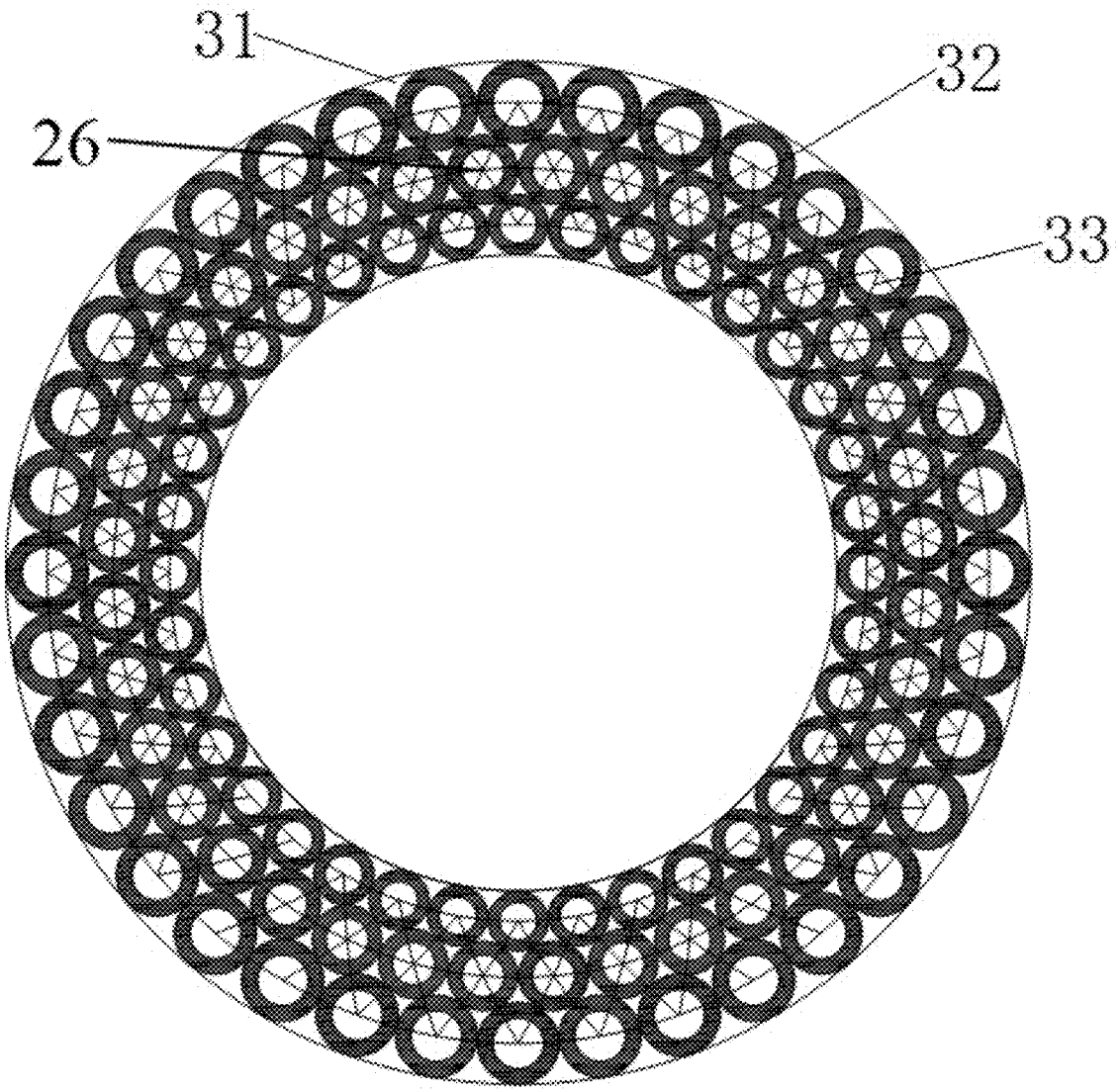
FIG. 3 is a cross-section diagram of one embodiment of a radial protection structure along the radial direction of a tunnel provided by the present disclosure.
Figure 4:
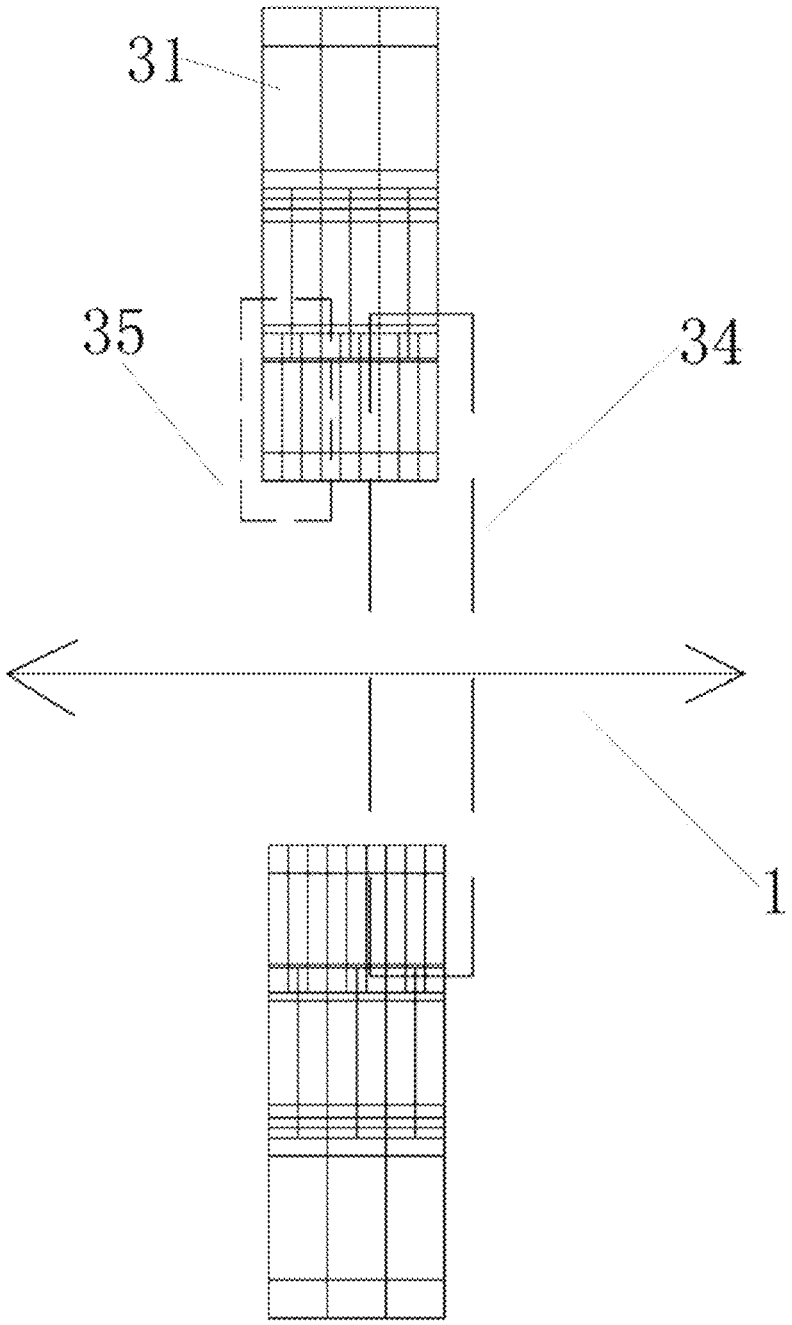
FIG. 4 is a cross-section diagram of one embodiment of a radial protection structure along the axial direction of a tunnel provided by the present disclosure.
Figure 5:
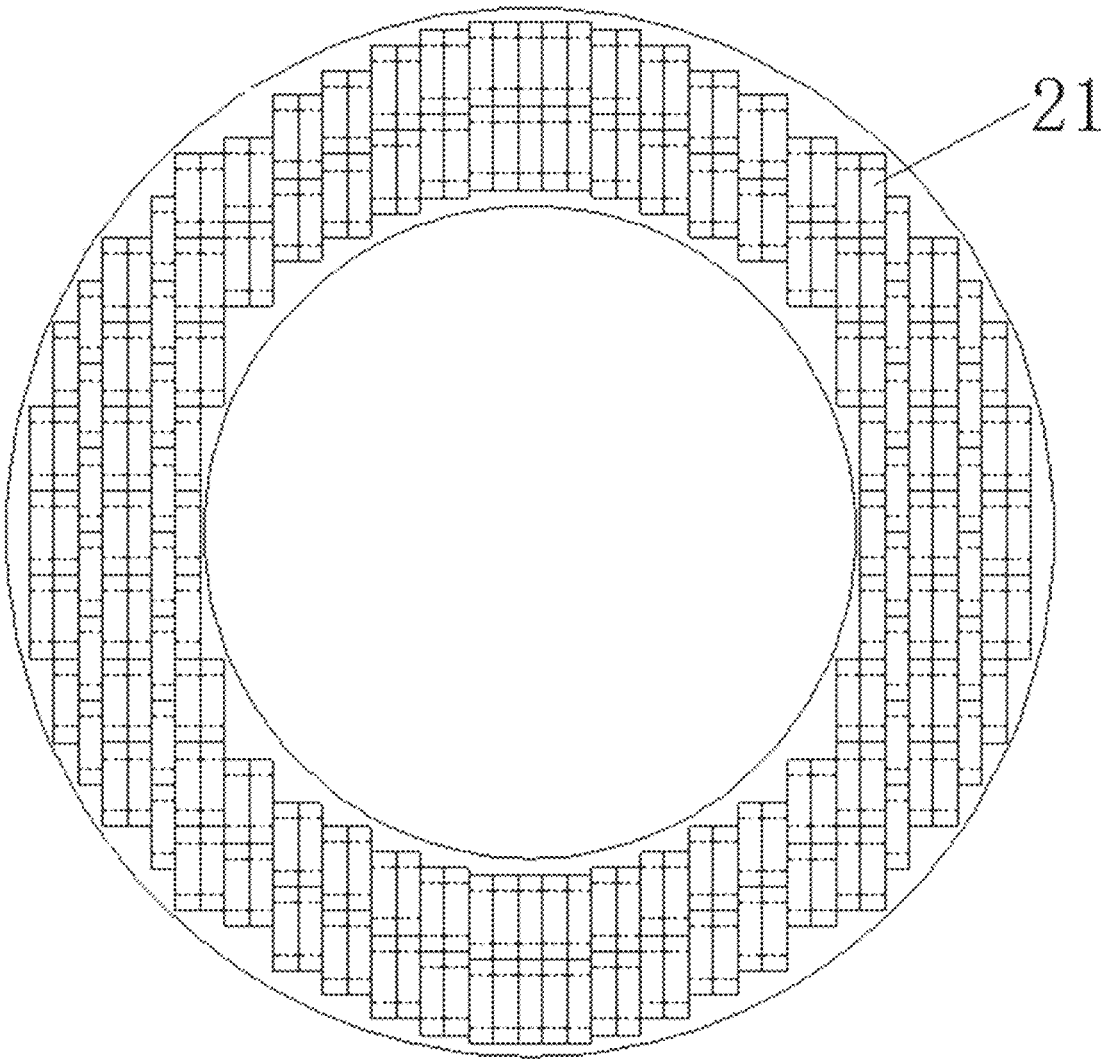
FIG. 5 is a cross-section diagram of one embodiment of an axial protection structure along the radial direction of a tunnel provided by the present disclosure.
Figure 6:
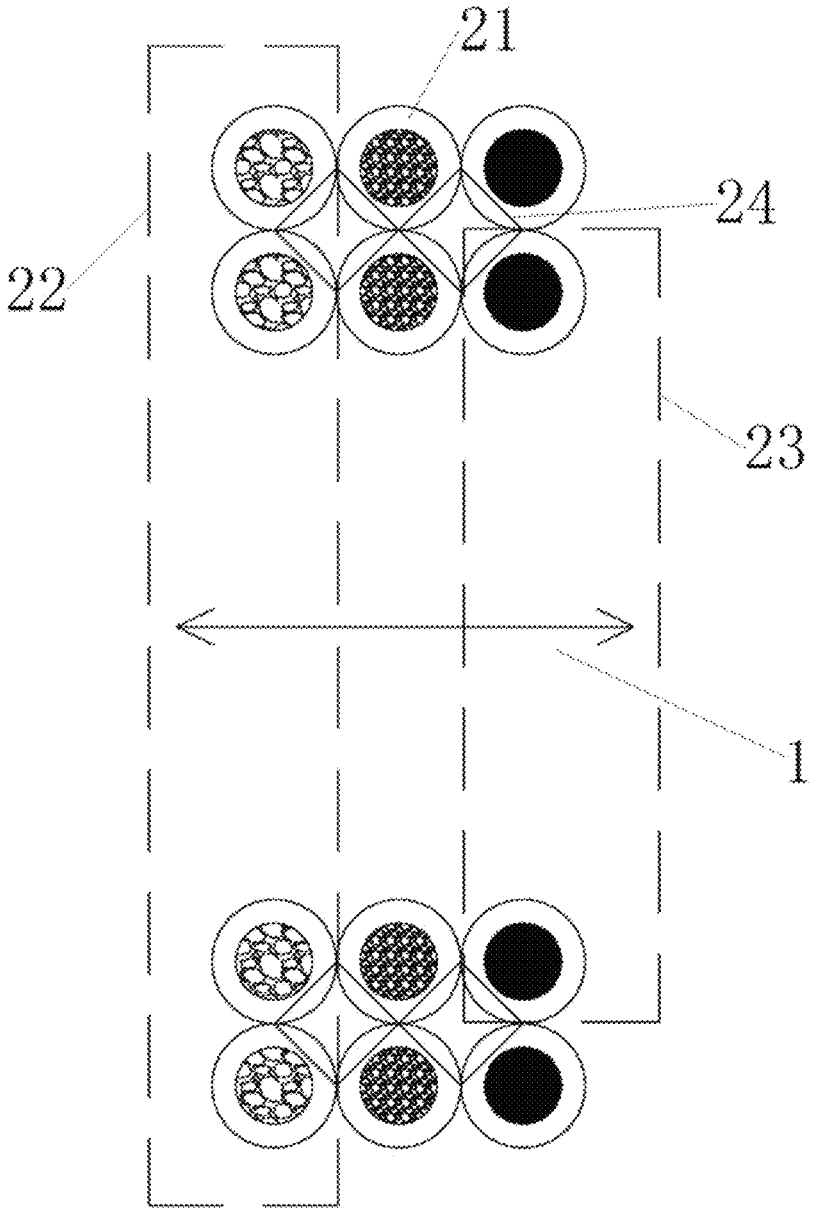
FIG. 6 is a cross-section diagram of one embodiment of an axial protection structure along the axial direction of a tunnel provided by the present disclosure.
Figure 7:
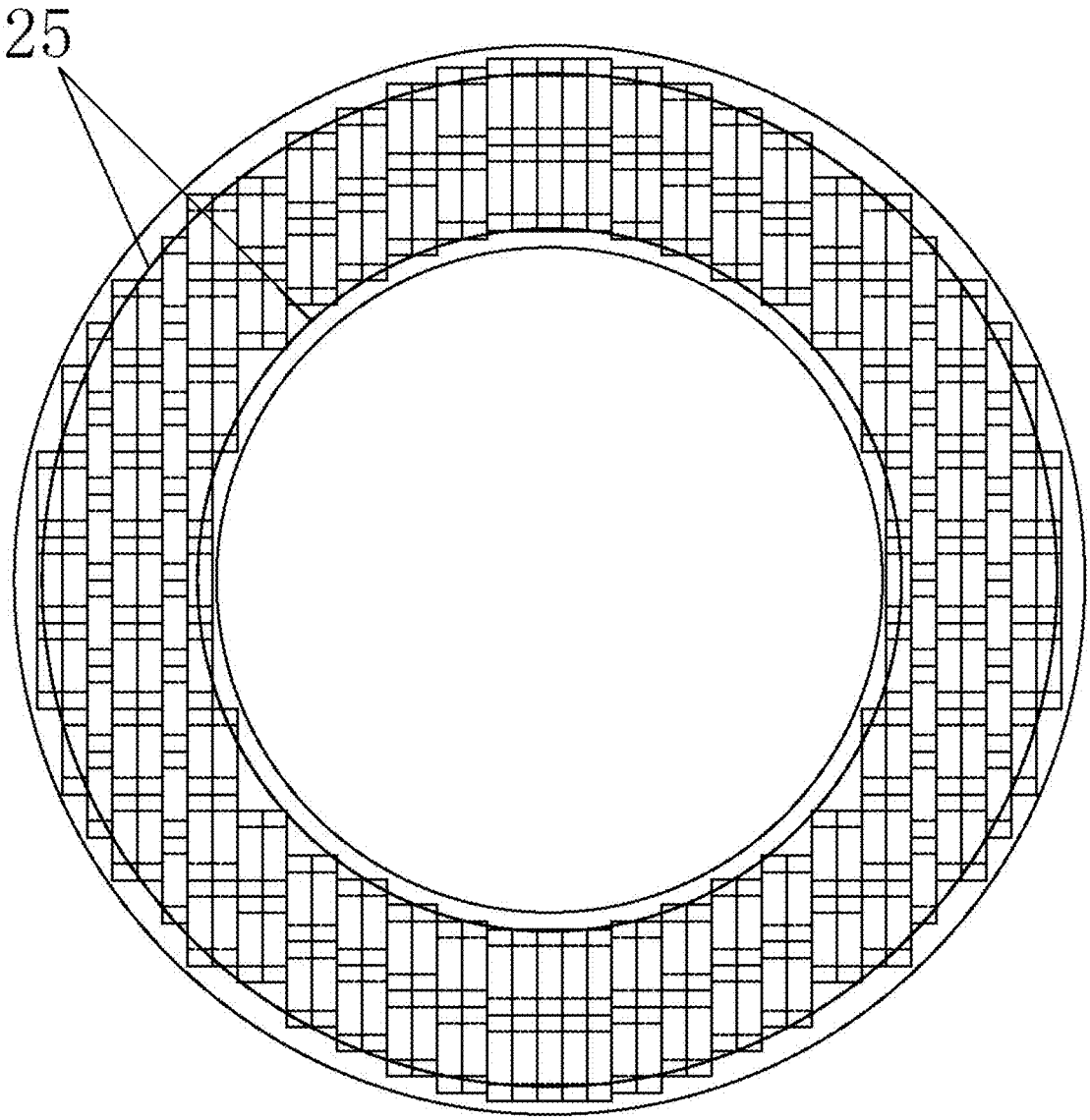
FIG. 7 is a cross-section diagram of one embodiment of an axial protection structure along the radial direction of a tunnel provided by the present disclosure.

The embodiment provides a tunnel protection structure (100) suitable for active fault areas and high ground stress areas, as shown in FIG. 1 to FIG. 7, comprising at least one protection unit (400), wherein a plurality of protection units (400) are sequentially connected and distributed along the axial direction (1) of a tunnel, preferably, the adjacent protection units are in contact and are fixedly connected, the protection units (400) comprise a radial protection ring (3) and two axial protection rings (2) which are fixedly arranged between a lining structure (300) and surrounding rock (200) and are distributed along the axial direction (1) of the tunnel, and the two axial protection rings (2) are respectively arranged on the two sides of the radial protection ring (3); the radial protection ring (3) comprises a plurality of radial buffer energy consumption layers which are sequentially sleeved along the radial direction of the tunnel, specifically, the radial direction is a direction perpendicular to the axial direction, each radial buffer energy consumption layer has radial buffer performance and radial energy consumption performance, and the radial buffer performance of each radial buffer energy consumption layer is gradually increased and the radial energy consumption performance of each radial buffer energy consumption layer is gradually decreased from outside to inside along the radial direction of the tunnel; and the axial protection ring (2) comprises a plurality of axial buffer energy consumption layers (22) which are sequentially and fixedly connected along the axial direction (1) of the tunnel, each axial buffer energy consumption layer (22) has axial buffer performance and axial energy consumption performance, and the axial buffer performance of each axial buffer energy consumption layer (22) is gradually increased and the axial energy consumption performance of each axial buffer energy consumption layer (22) is gradually decreased from outside to inside along the axial direction (1) of the tunnel.

When surrounding rock (200) is seriously deformed, firstly, the radial buffer energy consumption layer and the axial buffer energy consumption layer (22) on the outer layer perform energy consumption on radial large deformation and axial large deformation respectively, in the deformation process of the surrounding rock (200), the radial high-strain energy and the axial high-strain energy are rapidly reduced, then the radial buffer energy consumption layer and the axial buffer energy consumption layer (22) on the inner layer buffer the radial large deformation and the axial large deformation respectively, and the situation that radial deformation of surrounding rock (200) is transmitted to the tunnel to damage the tunnel is avoided.

Further, each radial buffer energy consumption layer comprises a plurality of radial tire layers (34) which are sequentially and fixedly connected around the axis of the tunnel, each radial tire layer (34) comprises a plurality of radial tires (31) which are annularly distributed around the axial direction (1) of the tunnel and are sequentially and fixedly connected, and the axis of each radial tire (31) is parallel to the axis of the tunnel; each axial buffer energy consumption layer (22) comprises a plurality of axial tire layers (23) sequentially sleeved along the radial direction of the tunnel, each axial tire layer (23) comprises a plurality of axial tires (21) annularly distributed around the axis of the tunnel and sequentially and fixedly connected, and the axis of each axial tire (21) is perpendicular to the axis of the tunnel; and the radial tires (31) and the axial tires (21) are filled with buffer energy consumption materials, the buffer performance of the buffer energy consumption material filled in the radial tire (31) is gradually increased and the energy consumption performance of the buffer energy consumption material filled in the radial tire (31) is gradually decreased from outside to inside along the radial direction of the tunnel, and the buffer performance of the buffer energy consumption material filled in the axial tire (21) is gradually increased and the energy consumption performance of the buffer energy consumption material filled in the axial tire (21) is gradually decreased from outside to inside along the axial direction (1) of the tunnel. Both the axial tire (21) and the radial tire (31) have a buffer function, and the axial tire (21) and the radial tire (31) are combined with the buffer energy consumption material to jointly resist large deformation of the surrounding rock.

Further, the number of the radial buffer energy consumption layers and the number of the axial buffer energy consumption layers (22) are each three, the radial tire (31) and the axial tire (21) on the outermost layer are filled with energy consumption materials composed of construction waste such as concrete blocks, gravel blocks, brick and tile fragments and muck and coal gangue, the fineness modulus is "large", the compactness is "slightly dense", and the grading form is an "intermittent" grading form; the radial tire (31) and the axial tire (21) on the middle layer are filled with energy consumption materials composed of coal gangue, steel slag and the like, the fineness modulus is "medium", the compactness is "medium", and the grading form is a "continuous opening" grading form; and the radial tire (31) and the axial tire (21) on the inner layer are filled with energy consumption materials composed of steel slag, coal ash, red mud, phosphogypsum and the like, the fineness modulus is "small", the compactness is "compact", and the grading form is a "continuous" grading form. Bulk solid wastes are directly converted into building materials, so that the comprehensive utilization efficiency of the bulk solid wastes is improved while the buffer energy consumption effect is met, and the cost of tunnel engineering is reduced.

Further, the diameter and the thickness of each radial tire (31) are gradually increased from inside to outside along the radial direction of the tunnel, the thicknesses of the radial buffer energy consumption layers along the axial direction (1) of the tunnel are the same, and each radial tire (31) can abut against at least two adjacent radial tires (31) in the adjacent buffer energy consumption layers. Due to the arrangement, the arrangement of the radial tires (31) is more compact, and the buffer energy consumption performance of the axial protection ring (2) is improved.

Further, the gaps between the adjacent radial tires (31), the gaps between the adjacent axial tires (21) and the gaps between the radial tires (31) and the axial tires (21) which are adjacent to each other are filled with the buffer energy consumption materials, specifically, the gaps are filled with the energy consumption materials composed of coal gangue, steel slag, coal ash, red mud, ardealite and the like, the fineness modulus is "medium-small", the compactness is "dense", the grading form is a "continuous" grading form, and a buffer function is achieved.

Further, the radial tires (31) and the axial tires (21) are waste tires. The waste tires are directly converted into building materials, comprehensive utilization of the bulk solid wastes is achieved while the buffering effect is achieved, and the cost of tunnel engineering is reduced.

Further, the adjacent radial tire layers (34) are bonded and fixed.

Further, the centers of the radial tires (31) in the same radial tire layer (34) are sequentially connected through first anchor rods (32), a plurality of radial tires (31) distributed along the axial direction (1) of the tunnel in the same radial buffer energy consumption layer form a radial tire part (35), the thickness of the radial tire part is the same as that of the radial tire (31) of the outermost radial buffer energy consumption layer, and the centers of the adjacent radial tire parts (35) in every two adjacent radial buffer energy consumption layers are connected through second anchor rods (33).

Further, the axial tires (21) of the outermost axial tire layer (23) and the axial tires (21) of the innermost axial tire layer (23) are sequentially connected around the axis of the tunnel through third anchor rods (25) respectively, and contact points of the adjacent axial tires (21) located on different axial tire layers (23) are fixedly connected through fourth anchor rods (24) sequentially.

Further, the contact positions of the adjacent radial tires (31) and the adjacent axial tires (21) are fixedly connected through fifth anchor rods (26).

Further, the first anchor rods (32), the second anchor rods (33), the third anchor rods (25), the fourth anchor rods (24) and the fifth anchor rods (26) are all anchor rods with ideal elastic-plastic characteristics and axial deformation-radial coarsening characteristics, so that no matter for the movement conditions of different faults such as a normal fault, a reverse fault and a strike-slip fault, or the movement forms of fault stick-slip dislocation and creep-slip deformation, the anchor rod still keeps constant high strength even under large tensile and shear deformation conditions, a large deformation space is reserved for surrounding rock, and the anchor rod is in closer contact with tires and solid wastes due to the characteristic of radial coarsening after deformation of the anchor rods, so that the overall rigidity and strength of a tunnel engineering protection structure are enhanced.

According to the embodiment, the anchor rod groups acting on a radial protection structure and an axial protection structure are tightly connected with the tire groups in a special arrangement mode, the using amount of special anchor rod materials is saved to the maximum extent, and on the other hand, the material cost of the tunnel engineering protection structure is remarkably reduced.

According to the embodiment, under the complex stress conditions of static loads such as extremely high self-weight stress and structural stress and dynamic loads such as strong seismic stress waves and blasting stress waves, the coordinated deformation effect of the waste tire group and the anchor rod group and the movement rearrangement and particle crushing effect of solid waste blocks/particles are considered; and therefore, the combined functions of tire buffering, anchor rod energy absorption and block/particle energy consumption are fully exerted.

Specific examples are used for illustration of the principles and implementation methods of the present disclosure. The description of the above-mentioned embodiments is used to help illustrate the method and its core principles of the present disclosure. In addition, those skilled in the art can make various modifications in terms of specific embodiments and scope of application in accordance with the teachings of the present disclosure. In conclusion, the content of this specification shall not be construed as a limitation to the present disclosure.

What is claimed is:

1. A tunnel protection structure suitable for active fault areas and high ground stress areas, comprising a plurality of protection units, wherein each of said protection units are sequentially connected and distributed along the axial direction of a tunnel, wherein each of said protection unit comprise a radial protection ring and two axial protection rings which are fixedly arranged between a lining structure and surrounding rocks and are distributed along an axial direction of a tunnel, and said two axial protection rings are respectively arranged on the two sides of said radial protection ring;

the radial protection ring comprising a plurality of radial buffer energy consumption layers which are sequentially sleeved along a radial direction of the tunnel, each of said radial buffer energy consumption layer having radial buffer performance and radial energy consumption performance, and the radial buffer performance of each of said radial buffer energy consumption layer is gradually increased from outside to inside along the radial direction of the tunnel and the radial energy consumption performance of each of said radial buffer energy consumption layer is gradually decreased from outside to inside along the radial direction of the tunnel;

each of the two axial protection rings comprises a plurality of axial buffer energy consumption layers which are sequentially and fixedly connected along the axial direction of the tunnel, each of said axial buffer energy consumption layer has axial buffer performance and axial energy consumption performance, and the axial buffer performance of each of said axial buffer energy consumption layer is gradually increased from outside to inside relative to the radial protection ring along the axial direction of the tunnel and the axial energy consumption performance of each of said axial buffer energy consumption layer is gradually decreased from outside to inside relative to the radial protection ring along the axial direction of the tunnel in said each of the two axial protection rings;

a number of the plurality of radial buffer energy consumption layers in the radial protection ring is three and a number of the plurality of axial buffer energy consumption layers in the axial protection ring is three;

each of said radial buffer energy consumption layer comprises a plurality of radial tire layers which are sequentially and fixedly connected around the axis of the tunnel, each of said radial tire layer comprises a plurality of radial tires which are annularly distributed around the axial direction of the tunnel and are sequentially and fixedly connected, and an axis of each of said radial tire is parallel to the axis of the tunnel; each of said axial buffer energy consumption layer comprises a plurality of axial tire layers sequentially sleeved along a radial direction of the tunnel, each of said axial tire layer comprises a plurality of axial tires annularly distributed around the axis of the tunnel and sequentially and fixedly connected, and the axis of each of said axial tire is perpendicular to the axis of the tunnel; and each of said radial tire and each of said axial tire are filled with buffer energy consumption materials, buffer performance of the buffer energy consumption material filled in each radial tire is gradually increased from the outside to the inside along the radial direction of the tunnel and energy consumption performance of the buffer energy consumption material filled in each radial tire is gradually decreased from the outside to the inside along the radial direction of the tunnel, and the buffer performance of the buffer energy consumption material filled in each axial tire is gradually increased from the outside to the inside relative to said radial protection ring along the axial direction of the tunnel and the energy consumption performance of the buffer energy consumption material filled in each axial tire is gradually decreased from the outside to the inside relative to said radial protection ring along the axial direction of the tunnel in the axial protection ring; and the buffer energy consumption materials filled in each of said radial tire of an outermost layer of the radial buffer energy consumption layers and each of said axial tire of an the outermost layer of the axial buffer energy consumption layers is composed of concrete blocks, gravel blocks, brick and tile fragments, muck and coal gangue, and grading form is a "gap" grading form; the buffer energy consumption materials filled in each of said radial tire of a middle layer of said radial buffer energy consumption layers and each of said axial tire of a middle layer of the axial buffer energy consumption layers are composed of coal gangue and steel slag, and a grading form is a "continuous opening" grading form; the buffer energy consumption materials filled in each of said radial tire of an innermost layer of the radial buffer energy consumption layers and each of said axial tire of an innermost layer of the axial buffer energy consumption layers are composed of steel slag, coal ash, red mud and phosphogypsum, and a grading form is a "continuous" grading form; a fineness modulus of the buffer energy consumption material filled in each of said radial tire from the outside to the inside along the radial direction of the tunnel is gradually decreased, and a compactness is gradually increased from the outside to the inside along the radial direction of the tunnel; and the fineness modulus of the buffer energy consumption material filled in each of said axial tire is gradually decreased from an outside to an inside relative to the radial protection ring along the axial direction of the tunnel in each of the axial protection ring, and the compactness is gradually increased from the outside to the inside relative to the radial protection ring along the axial direction of the tunnel.

2. The tunnel protection structure suitable for active fault areas and high ground stress areas according to claim 1, wherein a diameter and a thickness of each of said radial tire are gradually increased from the inside to the outside along the radial direction of the tunnel, and thicknesses of the radial buffer energy consumption layers along the axial direction of the tunnel are the same.

3. The tunnel protection structure suitable for active fault areas and high ground stress areas according to claim 2, wherein each of said adjacent radial tire layers are bonded and fixed.

4. The tunnel protection structure suitable for active fault areas and high ground stress areas according to claim 2, wherein centers of the radial tires in a same radial tire layer are sequentially connected through first anchor rods, a radial tire layer located on an outermost layer is an outward tire layer, a thickness of the outward tire layer is integral multiples of a thickness of each of said radial tire layer located between the outward tire layer and the tunnel, a plurality of radial tires distributed along the axial direction of the tunnel in the radial buffer energy consumption layer form a radial tire part, a thickness of the radial tire part is the same as that of the outward tire layer, and a center of every two adjacent radial tire parts in every two adjacent radial buffer energy consumption layers is connected through a second anchor rod.

5. The tunnel protection structure suitable for active fault areas and high ground stress areas according to claim 2, wherein the contact positions of adjacent radial tires and the adjacent axial tires are fixedly connected through fifth anchor rods.

6. The tunnel protection structure suitable for active fault areas and high ground stress areas according to claim 1, wherein gaps between adjacent radial tires, gaps between the adjacent axial tires, and gaps between the radial tires and the axial tires which are adjacent to each other are filled with the buffer energy consumption materials.

7. The tunnel protection structure suitable for active fault areas and high ground stress areas according to claim 1, wherein the radial tires and the axial tires are waste tires.

8. The tunnel protection structure suitable for active fault areas and high ground stress areas according to claim 1, wherein the axial tires of the outermost axial tire layer and the axial tires of the innermost axial tire layer are sequentially connected around the axis of the tunnel through third anchor rods respectively, and contact points of adjacent axial tires located on different axial tire layers are fixedly connected through fourth anchor rods sequentially.

* * * * *